US010927836B2

(12) United States Patent
Martens

(10) Patent No.: US 10,927,836 B2
(45) Date of Patent: Feb. 23, 2021

(54) METHOD FOR COOLING A LIQUID-INJECTED COMPRESSOR ELEMENT AND LIQUID-INJECT COMPRESSOR ELEMENT FOR APPLYING SUCH A METHOD

(75) Inventor: Kristof Adrien Laura Martens, Grimbergen (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 761 days.

(21) Appl. No.: 12/922,924

(22) PCT Filed: Mar. 25, 2009

(86) PCT No.: PCT/BE2009/000019
§ 371 (c)(1),
(2), (4) Date: Sep. 16, 2010

(87) PCT Pub. No.: WO2009/121151
PCT Pub. Date: Oct. 8, 2009

(65) Prior Publication Data

US 2011/0014077 A1 Jan. 20, 2011

(30) Foreign Application Priority Data

Mar. 31, 2008 (BE) ..... 2008/0199

(51) Int. Cl.
*F04C 29/04* (2006.01)
*F04C 29/02* (2006.01)
*F04C 18/16* (2006.01)

(52) U.S. Cl.
CPC ..... *F04C 29/042* (2013.01); *F04C 18/16* (2013.01); *F04C 29/021* (2013.01); *F04C 2270/02* (2013.01)

(58) Field of Classification Search
CPC ..... F04C 27/00; F04C 29/02; F04C 29/0014; F04C 29/0007; F04C 29/042; F04C 18/16;
(Continued)

(56) References Cited

U.S. PATENT DOCUMENTS 4,180,986 A * 1/1980 Shaw ..... F04C 28/06 418/84
5,140,828 A * 8/1992 Hagita et al. ..... 62/222
(Continued)

FOREIGN PATENT DOCUMENTS

EP 0007295 A2 1/1980
EP 0172430 * 2/1986 ..... F04C 29/04
(Continued)

OTHER PUBLICATIONS

International Search Report in PCT/BE2009/000019, dated Sep. 2, 2009.
(Continued)

*Primary Examiner* — Bryan M Lettman
(74) *Attorney, Agent, or Firm* — Bacon & Thomas, PLLC

(57) ABSTRACT

Method for cooling a liquid-injected compressor element, where a liquid is injected in the compression chamber of the compressor element (2) via an injection valve (13). The method includes the step of adjusting the quantity of liquid which is injected in the compression chamber of this compressor element (2) as a function of a specific adjusting parameter, irrespective of any other possible adjustments. The quantity of liquid to be injected is adjusted by using a second injection valve (19), which has the shape of an adjustable valve to this end.

12 Claims, 1 Drawing Sheet

(58) Field of Classification Search
CPC ..... F04C 2270/19; F04C 2270/195; F04C 29/04; F04C 29/021; F04C 2270/02; F02B 47/02; F02D 21/00; F02M 25/00; F01D 25/18; F01D 25/20; F02C 7/06
USPC ..... 417/228, 278, 281, 282, 292; 418/97, 418/100, DIG. 1
See application file for complete search history.

(56) References Cited

U.S. PATENT DOCUMENTS

| | | | | |
|---|---|---|---|---|
| 5,243,827 | A * | 9/1993 | Hagita | F04C 29/042 62/113 |
| 5,318,151 | A | 6/1994 | Hood et al. | |
| 6,202,424 | B1 | 3/2001 | Hattori et al. | |
| 6,843,836 | B2 * | 1/2005 | Kitchener | 96/234 |
| 7,094,037 | B2 * | 8/2006 | Nakamura et al. | 417/63 |
| 2008/0078192 | A1 * | 4/2008 | Ignatiev | F25B 1/10 62/184 |

FOREIGN PATENT DOCUMENTS

| | | | | |
|---|---|---|---|---|
| EP | 0172430 | A1 | 2/1986 | |
| EP | 1451469 | B1 | 10/2008 | |
| GB | 2111662 | A | 7/1983 | |
| JP | S49-84711 | U | 7/1974 | |
| JP | S4984711 | * | 7/1974 | |
| JP | S52-054906 | | 4/1977 | |
| JP | S58-140498 | A | 8/1983 | |
| JP | H08-004679 | A | 1/1996 | |
| JP | H08-500884 | A | 1/1996 | |
| JP | 2002039069 | A | 2/2002 | |
| JP | 2002317786 | A | 10/2002 | |
| WO | WO2007045052 | * | 4/2007 | F04C 29/02 |
| WO | WO2007076213 | * | 7/2007 | F04C 29/00 |

OTHER PUBLICATIONS

Japanese Office Action dated Nov. 25, 2014, for JP 2013-251843, and English translation thereof.
Third Party Observation Letter dated Apr. 29, 2015 for EP 09726773.6.

* cited by examiner

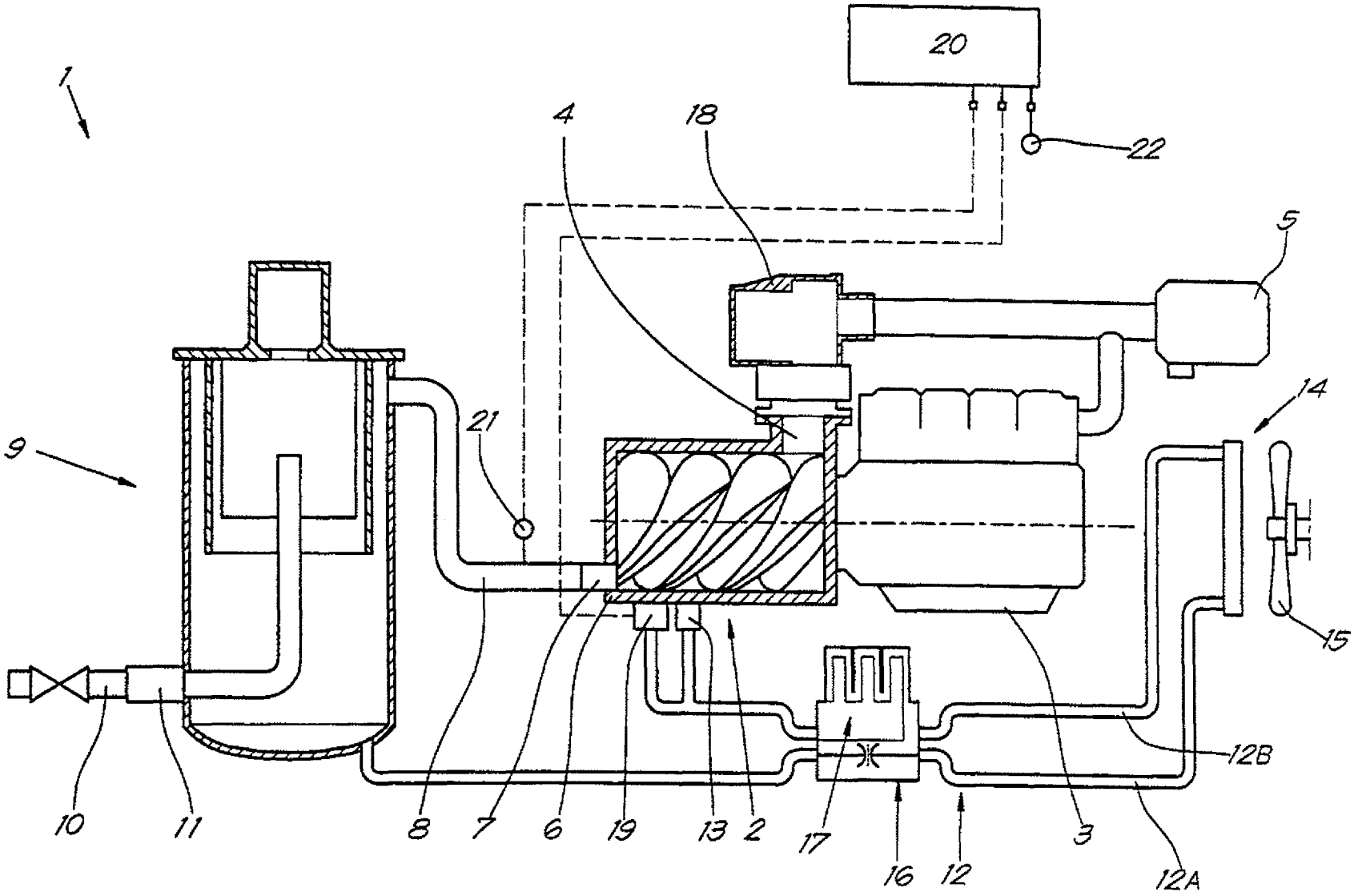
1
2
3
4
5
6
7
8
9
10
11
12
12A
12B
13
14
15
16
17
18
19
20
21
22

METHOD FOR COOLING A LIQUID-INJECTED COMPRESSOR ELEMENT AND LIQUID-INJECT COMPRESSOR ELEMENT FOR APPLYING SUCH A METHOD

BACKGROUND OF THE INVENTION

1. Field of the Invention

The present invention concerns a method for cooling a liquid-injected compressor element.

2. Discussion of the Related Art

At present, in order to cool a liquid-injected compressor element, a liquid such as water or oil, injected in the compression chamber of the compressor element concerned by means of injection openings provided to that end in the compressor element, is supplied as of one and the same injection valve.

The injected liquid concerned hereby not necessarily merely has a cooling function, but it can also provide for the lubrication and/or sealing of the moving parts, such as for example the rotors of a screw compressor element.

The injected liquid leaves the compressor element together with the compressed gas, via the compressed air outlet of the compressor element, after which the mixture of compressed gas and liquid is sent through a liquid separator so as to separate the liquid from the compressed gas flow.

Next, the separated liquid is carried back to the injection valve, via a cooler, to be then injected again in the compressor element.

SUMMARY OF THE INVENTION

In practice it is found that, when a compressor element is turning at a higher speed or at a higher working pressure, more heat is generated for the same quantity of injected liquid, which leads to a stronger increase in temperature of the liquid through the compressor element.

In practice it is found that, when a compressor is turning under hot environmental conditions (i.e. with cooling agents at high temperatures), the temperature of the liquid/gas mixture at the outlet of the compressor element may increase considerably.

In case oil is used as an injection liquid, it is important that the temperature of the oil/gas mixture at the outlet of the compressor element is not too high, since a temperature increase of 10° C. can already halve the life of the oil.

Also when using other liquids, such as for example water, one must make sure that the temperature at the compressed air outlet of the compressor element does not rise too much, since the materials used for the rotors, coatings and the like cannot endure unlimited high temperatures and since this may have a negative influence on the viscosity of the liquid, which is disadvantageous to the lubrication and sealing qualities.

The minimally achievable temperature of the injected liquid is restricted by the temperature of the cooling agent which is used in the cooler. The temperature of the injection liquid can only be further decreased by using overdesigned heat exchangers for low cooling agent temperatures, which are disadvantageous in that they are sizeable and expensive.

The present invention aims to remedy one or several of the above-mentioned and other disadvantages.

To this end, the present invention concerns a method for cooling a liquid-injected compressor element, whereby a liquid is injected in the compression chamber of said compressor element via an injection valve, said method comprising the step of adjusting the quantity of liquid which is injected in the compression chamber of said compressor element as a function of a specific adjusting parameter, irrespective of any other possible adjustments characterised in that the quantity of liquid to be injected is adjusted by means of a second injection valve, which has the shape of an adjustable valve to this end.

An advantage of such a method according to the invention is that more liquid can be injected, such that the temperature rises less. This allows for a higher injection temperature without exceeding the maximum outlet temperature, such that no overdesign of the cooler is required in the case of a low cooling agent temperature.

What is more, since the quantity of the injected liquid is adjusted irrespective of any other possible adjustments, this results in a very simple adjustment algorithm.

According to a preferred characteristic of the method according to the invention, the quantity of liquid which is injected is adjusted on the basis of a temperature measurement, for example of the temperature of the compressed gas flow leaving the compressor element and/or the ambient temperature.

Such an adjustment as a function of a measured temperature value makes it possible to optimize the output of the compressor element under any working condition whatsoever.

For, in case of low ambient temperatures, one can make sure in this way that the quantity of oil which is injected in the compression chamber is such that only a limited oil flow is supplied, such that an optimum is reached for the combined losses in the compressor element resulting from said injected liquid flow and the energy consumption of the cooling unit, such that, on the whole, energy is saved.

In this way can be made sure that the quantity of oil which is injected in the compression chamber at high ambient temperatures is such that a much larger oil flow is supplied, such that the quantity of cooling agent and/or the capacity of the cooling unit must not be increased very much, such that, on the whole, energy can be saved again.

The present invention also concerns a liquid-injected compressor element which makes it possible to apply the method as described above, whereby this compressor element is provided with an injection valve for injecting a liquid in a compression chamber of said compressor element, and whereby this compressor element is characterised in that the quantity of liquid which is injected in the compression chamber can be adjusted, as the compressor element is provided with a second injection valve for injecting liquid in the above-mentioned compression chamber, said second injection valve being made as a controllable valve which is connected to a regulator.

Preferably said regulator is connected to at least one temperature sensor for measuring the temperature at a compressed air outlet of the compressor element and/or for measuring the ambient temperature.

BRIEF DESCRIPTION OF THE DRAWINGS

In order to better explain the characteristics of the present invention, the following preferred variants of a method according to the invention for cooling a liquid-injected compressor element and a compressor element for applying such a method are described by way of example only without being limitative in any way, with reference to the accompanying drawing which schematically represents a compressor installation which is provided with a compressor element according to the invention.

DESCRIPTION OF SOME PREFERRED EMBODIMENTS

The compressor unit 1 in the FIGURE is in this case realised as an oil-injected screw compressor which is provided with a compressor element 2 which is in this case driven by an electric motor 3 and which is provided with an air inlet 4 to draw in a gas to be compressed via an air filter 5, and with a compressed air outlet 6 which opens into a pipe 8 via a non-return valve 7 which is connected to a liquid separator 9 of a known type.

By the compressed air outlet 6 is meant the outlet of the compressor element 2 through which the mixture of compressed gas and injected liquid is pressed out of the compression chamber.

Via a compressed air line 10 which is connected to the above-mentioned liquid separator 9 via a minimum pressure valve 11, compressed gas at a certain working pressure can be taken off by users of compressed air, such as for example to feed a compressed air network or the like.

The above-mentioned liquid separator 9 is connected to the above-mentioned compressor element 2 by means of an injection pipe 12, in particular to a first injection valve 13 which is provided on this compressor element 2.

In the above-mentioned injection pipe 12 is provided a cooler 14 which in this case, but not necessarily, is realised as an air-cooled heat exchanger, as a result of which the above-mentioned injection pipe 12 is divided in a first part 12A which extends between the liquid separator 9 and the cooler 14, and a second part 12B which extends between the cooler 14 and the compressor element 2.

Opposite the above-mentioned cooler 14 is in this case provided a fan 15 which is driven by driving means such as an electric motor or the like, not represented in the figures.

In the first part 12A of the above-mentioned injection pipe 12 is in this case provided a thermostatic by-pass valve 16 of a known type which can bridge the above-mentioned cooler 14 as it is connected to the above-mentioned second part 12B of the injection pipe 12.

In this case, an oil filter 17 is further provided in the above-mentioned second part 12B of the injection pipe which may be integrated in the same housing as the above-mentioned thermostatic by-pass valve 16 in the first part 12A of the injection pipe 12 if need be.

If required, the compressor unit 1 may be further provided with a flow control device, not represented in the figures, comprising an inlet valve 18 which is provided at the air inlet 4 of the compressor element 2 and which is composed in the known manner of a housing in which a valve element can shift between an open position in which the inlet opening for the sucked-in gas is maximal, and a closed position in which the inlet opening is entirely sealed.

According to the invention, the quantity of liquid which is injected in the compression chamber can be adjusted, in this case as the compressor element 2 is provided with a second injection valve 19 onto which is connected a branch of the injection pipe 12, in particular of the second part 12B of said injection pipe 12.

According to the invention, the above-mentioned second injection valve 19 is realised as an adjustable valve which is preferably connected to a control unit 20 which is also connected to measuring sensors.

The above-mentioned measuring sensors in this example comprise a first temperature sensor 21 provided in the compressed air outlet 6 of the compressor element 2, and a second temperature sensor 22 which can be provided for example on the housing of the compressor unit to measure the ambient temperature.

According to the invention, the above-mentioned second injection valve 19 can be realised in many ways, and it preferably consists of an electrically controllable valve which can be continuously adjusted, in other words having a continuously variable flow-through opening.

However, this is no prerequisite according to the invention, since use can also be made of a valve whose flow-through opening can be adjusted according to a number of fixed stages. The injection valve 19 may also be pneumatically controlled or may be made as a thermostatic valve.

A method according to the invention for cooling a liquid-injected compressor element is very simple and as follows.

While the compressor unit 1 is operational, the electric motor 3 drives the compressor element 2, such that atmospheric air is drawn in via the air filter 5 through the inlet valve 18.

According to the invention, in order to discharge compression heat in the compressor element 2, via the injection pipe 12 and the first and second injection valve 13, 19 respectively, cooled liquid coming from the cooler 14 will be supplied, in this case oil.

Thanks to the presence of a second injection valve 19, a larger quantity of oil can be injected in the compression chamber of the compressor element 2, as a result of which the temperature at the compressed air outlet 6 can be kept low even at high ambient temperatures and/or high compressor speeds and/or high compressor pressures, whereas the oil which is injected must not be additionally cooled, such that no overdesign of the cooler 14 is required in case of use at low ambient temperatures and/or rotational speeds and/or pressures.

In this way is also made sure that the heating of the oil over the compressor element 2 decreases at the same capacity compared to the conventional compressor elements having only one injection valve.

In this example, the second injection valve 19 is made as an adjustable valve which is controlled by a control unit 20.

According to the invention, the quantity of liquid which is injected in the compression chamber is adjusted on the basis of a specific adjusting parameter, irrespective of any other possible adjustments.

In the present example, this is realised in that the quantity of liquid which is injected via the second injection valve 19 is adjusted on the basis of at least one temperature measurement, in this case two measurements, namely the temperature of the compressed gas flow leaving the compressor element, which temperature is measured by the first temperature sensor 21, and the ambient temperature which is measured by the second temperature sensor 22.

An advantage thereof is that the quantity of oil which is injected in the compression chamber of the compressor element 2 can be adjusted as a function of the ambient temperature, such that at any ambient temperature whatsoever, the output of the compressor unit, which is composed of the drive of the compressor element and the cooling unit, can be optimised.

At low ambient temperatures can be made sure in this way that the quantity of oil which is injected in the compression chamber is determined such that an optimum is reached between the losses resulting from said oil flow into the compressor element and the cooling capacity of the cooling unit, such that energy is saved.

Thanks to the possibility of having a larger injection flow in the compression chamber, a good operation of the compressor unit will be guaranteed, even at high ambient temperatures of for example over 40° C., without the cooler 14 having to be seriously overdesigned to work at lower ambient temperatures, and without the life span of the oil being negatively influenced.

It is clear that the control of the second injection valve 19 can be realised in many ways, for example by adjusting the measured temperature at the compressed air outlet 6 to a certain desired value which either or not varies as a function of the ambient temperature.

If this desired value varies, it can be calculated by means of an algorithm which is a function of the ambient temperature.

It is also possible to adjust the measured temperature at the compressed air outlet between pre-set upper and lower limit values which either or not vary as a function of the ambient temperature.

Here as well, the upper and lower limit values concerned can be calculated by means of an algorithm which is a function of the ambient temperature.

An advantage of providing a lower limit value consist in that condensate being formed in the injected liquid can be avoided by sufficiently closing the second injection valve 19 at high operating pressures and high ambient temperatures with a high relative humidity.

Further, the working of the compressor unit 1 in the FIGURE is analogous to that of the known compressor units, whereby a mixture of compressed gas and oil is carried to the liquid separator 9, where the oil is separated from the compressed air in the known manner under the influence of centrifugal forces.

The purified compressed air can subsequently be taken off via the above-mentioned minimum pressure valve 11 and the compressed air line 10 to be used in all sorts of compressed air applications.

The oil which is recycled from the compressed air in the liquid separator 9 is collected at the bottom of said liquid separator 9 and it is pressed through the injection pipe 12 to the cooler 14 by the pressure $p_w$ prevailing in said liquid separator 9, where the oil is cooled by the fan 15.

In the given example is only mentioned an oil-injected compressor element, but the invention can also be applied to compressor elements whereby another liquid is injected in the compression chamber, such as for example in the case of a water-lubricated compressor element.

Naturally, the liquid which is injected via the injection valves 13 and 19 must not necessarily originate from a liquid separator according to the invention; on the contrary, this liquid may also be supplied from a separate reservoir.

Nor must the cooler 14 be necessarily made as an air-cooled heat exchanger, for this cooler may be any type of heat exchanger.

According to a variant of a method according to the invention which is not represented in the figures, the quantity of injected liquid can also be adjusted by means of only one injection valve 13 which can be adjusted either or not continuously to this end as a function of a specific adjusting parameter, irrespective of any other possible adjustments.

In the latter case, no additional injection valve must be provided apart from the injection valve 13.

The quantity of liquid to be injected in the compression chamber must not necessarily be adjusted by means of a regulator 20 according to the invention.

Thus, also a capillary tube may be used according to the invention which measures the outlet temperature of the compressor element and sets or adjusts the additional oil-injection directly in a continuous manner.

Use can also be made for example of a bimetal reacting directly to for example the outlet temperature of the compressor element.

In the above-described examples, the specific adjusting parameter on the basis of which the quantity of injected liquid is adjusted always consists of a temperature value but, according to the invention, this is no prerequisite since this adjusting parameter may for example also consists of:

- the total efficiency of the process (capacity measurement as adjusting parameter);
- the efficiency of the cooling of the liquid (capacity of the cooling unit of the liquid as adjusting parameter);
- the life of the liquid (oil quality measurement as adjusting parameter);
- or the like.

The present invention is by no means restricted to the embodiments and methods described by way of example and represented in the accompanying drawings; on the contrary, such a method according to the invention for cooling a liquid-injected compressor element and a compressor element for applying such a method can be made in all sorts of variants while still remaining within the scope of the invention.

The invention claimed is:

1. A method for cooling a liquid-injected air compressor element having a compression chamber into which an oil or water is injected via a first injection valve and a second injection valve, said method comprising the steps:

- compressing air in the compression chamber of the air compressor element;
- collecting the oil or water from the compressed air and recycling the oil or water from a liquid separator;
- injecting a first quantity of the oil or water from the liquid separator into the compression chamber via the first injection valve including a first injection opening on or in the compressor element;
- injecting a second quantity of the oil or water from the liquid separator into the compressor chamber via the second injection valve including a second injection opening on or in the compressor element;
- controlling a total quantity of the oil or water injected into the compression chamber through both the first injection valve and the second injection valve and adjusting the total quantity as a function of a specific adjusting parameter, irrespective of any other possible adjustments, wherein the total quantity of the oil or water comprises the first quantity and the second quantity of the oil or water, and wherein the total quantity of the oil or water is greater than the first quantity of oil or water,
- wherein the total quantity of oil or water injected into the compression chamber is only adjusted by means of said second injection valve that is configured as an adjustable valve having a continuously variable flow-through opening and controlled by a control unit to control the second quantity of oil or water into the compressor chamber,
- wherein the specific adjusting parameter is a temperature measurement at a compressed air outlet and a measured ambient temperature, wherein the total quantity of oil or water which is injected is adjusted based on said temperature measurement at the compressed air outlet and the measured ambient temperature; and adjusting a temperature at the compressed air outlet to a pre-set desired value by controlling the total quantity of oil or water that is injected, wherein said pre-set desired value for the temperature measurement at the compressed air outlet is calculated based on an algorithm which includes a function of the measured ambient temperature.

2. The method according to claim 1, including the step of adjusting the temperature at the compressed air outlet of the compressor element to the preset desired value by controlling the quantity of oil or water that is injected comprises the pre-set desired value comprising a pre-set upper and lower limit.

3. The method according to claim 2, wherein at least one of the upper and lower limit values are calculated based on an algorithm which is a function of the measured ambient temperature.

4. The liquid-injected air compressor element for carrying out the method of claim 1, comprising:

the air compressor element having the compression chamber and the first injection valve arranged to inject the first quantity of oil or water into the compression chamber;

the second injection valve arranged to control the second quantity of the oil or water injected into the compression chamber, said second injection valve being configured as the controllable adjustable valve which is connected to a regulator and controlled by the control unit, wherein the second injection valve has the continuously variable flow-through opening; and the control unit configured to adjust the temperature at the compressed air outlet to the pre-set desired value by controlling the total quantity of oil or water that is injected, wherein the total quantity of the oil or water comprises the first quantity and the second quantity of the oil or water, and wherein the total quantity of the oil or water is greater than the first quantity of oil or water, wherein said regulator is connected to at least one temperature sensor arranged to measure the temperature measurement at the compressed air outlet of the compressor element, and wherein the total quantity of oil or water injected into the compression chamber is only adjusted by said second injection valve based on said temperature measurement at the compressed air outlet.

5. The liquid-injected compressor element according to claim 4, wherein said second injection valve is configured as an electrically or pneumatically controllable valve.

6. The liquid-injected compressor element according to claim 4, wherein said second injection valve is adjustable in a continuous manner.

7. The liquid-injected compressor element according to claim 4, wherein said second injection valve is adjustable in a number of stages.

8. The method according to claim 1, wherein the temperature measurement is based on two temperature measurements.

9. The method according to claim 1, wherein the first quantity of oil or water is determined based on a minimum ambient temperature.

10. The method according to claim 1, wherein the oil or water injected into the compression chamber is cooled by an oil or water cooler without an overdesign of the oil or water cooler.

11. The method according to claim 1, wherein said air compressor element is a screw compressor element.

12. The method according to claim 1, where in the first injection opening is on the compressor element.

* * * * *